United States Patent [19]

Kupperman et al.

[11] 4,052,812

[45] Oct. 11, 1977

[54] TOY OBJECT THAT REPEATEDLY SUBMERGES AND RISES IN THE WATER

[75] Inventors: Sam Kupperman, Chicago; Dennis I. Kupperman, Glenview, both of Ill.

[73] Assignee: R B Toy Development Co., Skokie, Ill.

[21] Appl. No.: 689,941

[22] Filed: May 25, 1976

[51] Int. Cl.[2] ..... A63H 23/04

[52] U.S. Cl. ..... 46/94

[58] Field of Search ..... 46/91, 94

[56] References Cited

U.S. PATENT DOCUMENTS

| | | | |
|---|---|---|---|
| 1,318,049 | 10/1919 | Budde et al. | 46/94 |
| 1,361,561 | 12/1920 | Yancey | 46/94 |
| 2,712,710 | 7/1955 | Hirsch et al. | 46/94 |

*Primary Examiner*—Louis G. Mancene
*Assistant Examiner*—Robert F. Cutting
*Attorney, Agent, or Firm*—Vogel, Dithmar, Stotland, Stratman & Levy

[57] ABSTRACT

A toy object that repeatedly submerges and rises in the water, which toy is plastic molded and has a chamber for receiving baking powder and the like. The toy has a cap member integrally molded therewith and connected by a strap. The cap member serves to cover the powder chamber yet permits water to enter the powder chamber which will cause a bubble to be formed in a bubble or gas chamber on the underside of the cap, the cap also forming a holder for supporting a separately formed ballast rod in an off-center position. The toy will descend to the bottom of the water vessel and when the bubble forms in the bubble or gas chamber and enlarges it will cause the toy to ascend towards the top water level. The toy will remain at the top water level for a short period of time during the period that the bubble continues to enlarge in the bubble chamber and during this period the toy will be influenced to tip to one side due to the off-center ballast rod. After the bubble leaves the bubble chamber and breaks, the toy will straighten out and will then descend to the bottom of the water vessel. This action is repeated until the baking powder in the chamber is expended, after which it is refilled by removing the cap member. The integral formation of a toy with a cap member permits the toy to be formed of a small size, yet will pass Government safety standards in that it will not prove hazardous to small children who might try to place the toy in their mouths.

11 Claims, 5 Drawing Figures

FIG. 1
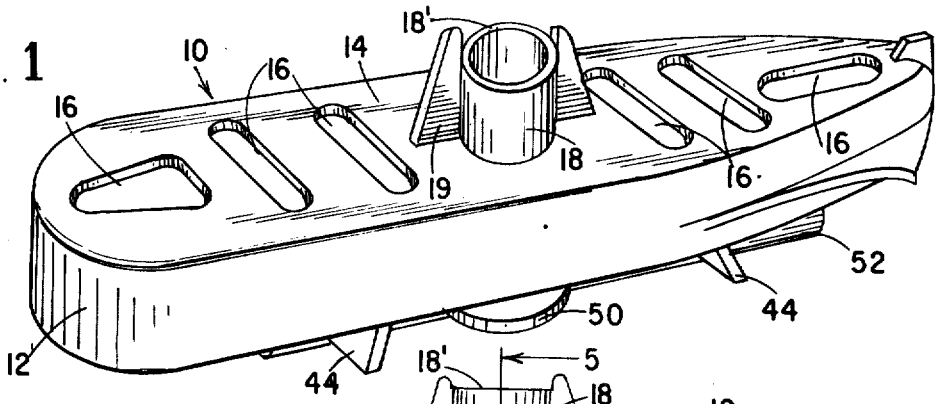
FIG. 2
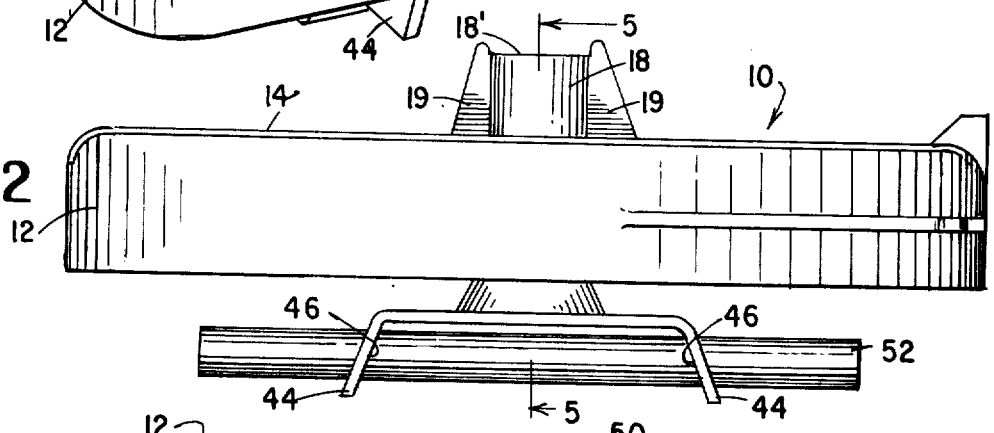
FIG. 3
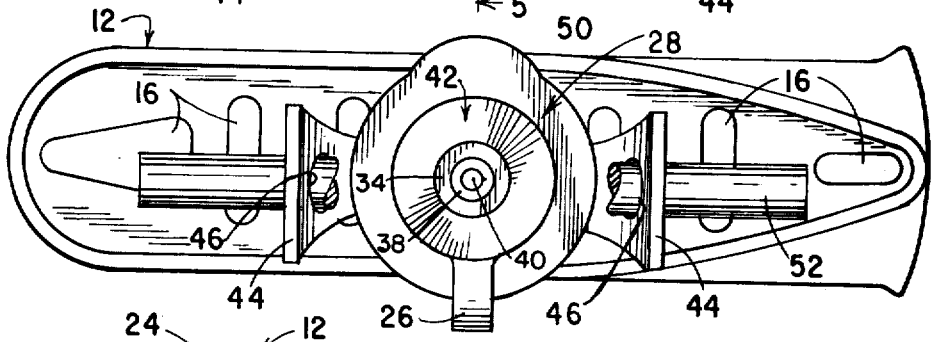
FIG. 4
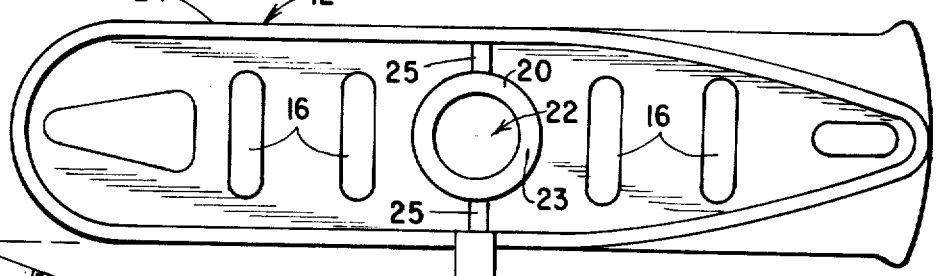
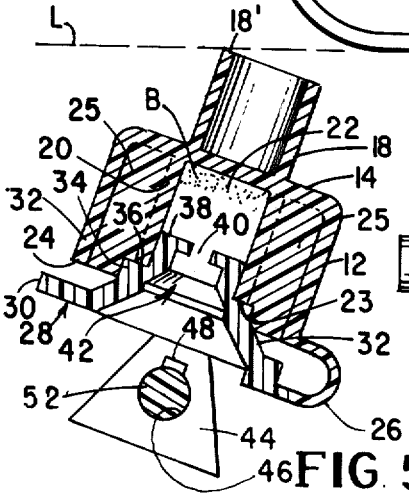
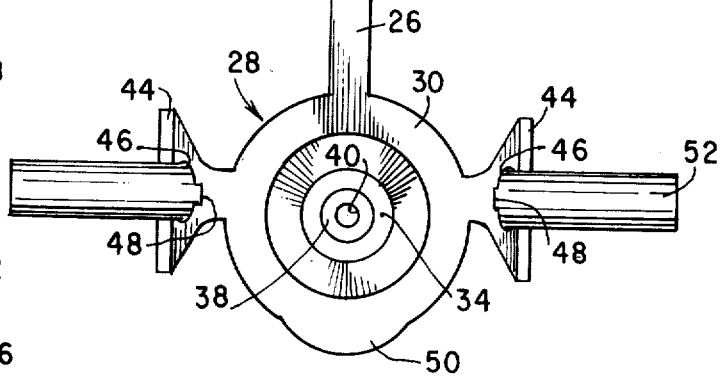
FIG. 5

TOY OBJECT THAT REPEATEDLY SUBMERGES AND RISES IN THE WATER

BRIEF SUMMARY OF THE INVENTION

One of the objects of this invention is to provide an object in the form of a toy having a chamber for receiving the gas forming substance such as baking powder or the like and in which the object or toy is provided with an off-center positioned ballast. Said toy object when placed in a vessel or container of water will descend in the water to the bottom to be submerged. The water mixing with the gas forming substance such as the baking powder or the like will cause the formation of gas to produce a bubble in a bubble or gas chamber and cause the toy object to rise in the water; after the toy object rises to the top, the bubble and the off-center ballast will influence the toy to tip to one side and the bubble will leave the bubble chamber which then causes the toy object to again descend into the water and be submerged with this procedure being repeated.

Another object of this invention is to provide a toy object formed of plastic material of the foregoing character in which the toy object includes a cap member which serves to cover the powder holding chamber to retain the powder therein and permit the entrance of water therein with the underside of the cap forming a gas or bubble chamber and having means whereby a ballast rod may be attached thereto. The cap is formed integrally with said main body object, whereby the toy may be economically produced and thereby eliminate any small separate objects which may be dangerous to children.

Another object is to provide a toy object of the character described in the form of a boat or a submarine or the like which is integrally molded of a plastic material and to which a ballast is readily attachable thereto, said ballast being formed of a vinyl plastic material. The toy, although small enough to be packaged in the container with a food product, such as cereal and the like, is of such size that it will pass the Government F.D.A. standards and will not contaminate or be injurious to the food.

Submersible objects which descend and rise in water and are operated through the medium of baking powder and the like are old in the art. However, such prior constructions are objectionable in that they are not integrally formed and comprise several small components which could be placed in the mouth of a young child and cause considerable injury if not a fatality to the child. Such prior constructions would not pass the present Federal Drug Administration regulations. An object of this invention, therefore, is to provide a toy object which is integrally molded of plastic material and in which the parts are so connected that they are molded integrally so that no separate parts are small enough to be placed in the mouth of a young child. Therefore, an object of this invention is to provide a toy object which meets the Federal Drug Administration regulations, is safe, inexpensive to manufacture and so inexpensive that it may be produced as a give-away product and packaged with cereals and the like in the same package.

BRIEF DESCRIPTION OF THE DRAWINGS

FIG. 1 is a view of this invention as embodied in the form of a toy submarine.

FIG. 2 is a side elevational view thereof.

FIG. 3 is a bottom plan view thereof but with the ballast rod broken away for purposes of clarity.

FIG. 4 is a plan view taken on the underside as same is integrally molded, but showing the separately formed ballast rod inserted for the purpose of clarity.

FIG. 5 is a sectional view taken on lines 5—5 of FIG. 3 and showing the toy tipped at the water level.

DESCRIPTION OF THE PREFERRED EMBODIMENTS

The toy object as shown in the drawings and hereinafter described is in the form of a submarine, but is not restricted thereto, as it will be understood that this invention may be embodied in any other toy objects of different shapes which would normally be submersible in water, for example, a diver, a fish, a mammal and the like, by way of illustration. The toy object as herein shown is only for illustrative purposes and shows a toy submarine generally indicated at 10 which is integrally formed and molded of a plastic material and comprises a hollow shell or body generally indicated at 12; the top or deck 14 is provided with a plurality of spaced openings 16 allowing the air bubbles to escape for permitting the toy object to submerge. The openings also aid in weight reduction. Extending upwardly of the deck 14 and centrally positioned is a tubular member 18 which is herein intended to simulate a conning tower of the submarine. Spaced ribs 19 extend on the opposite sides of the tubular portion 18. The bottom of the tubular member is closed by the deck 14 with the top of the tubular member being open. The top edge of the tubular member is indicated by the numeral 18'. The bottom of the shell or body 12 as best shown in FIGS. 3 and 4, is open. Extending inwardly into the hollow body 12 is a tubular member 20 (FIG. 5) which is aligned with tubular member 18 and therefore is centrally positioned with respect to the length and width of the shell or body 12. The tubular member 20 is open at the bottom and forms a chamber 22 for receiving the gas forming material, such as baking powder or any other substance which will produce a gas. Baking powder is the most economical and safest material to be used in this connection. The bottom edge 23 of the tubular member extends above the bottom edge 24 of the shell body 12. Oppositely positioned ribs 25 extend between the shell or body 12 and tubular member 20.

Attached to one side of the body or shell 12 adjacent the bottom thereof is a short flexible strap 26, the opposite end of which is attached to a cap member generally indicated at 28, which serves a threefold purpose, namely, to partially close the powder holding chamber 22 and serve as a cap therefor, to provide on the underside thereof a gas chamber or bubble chamber in which the bubble is formed and also to form a holder for the ballast rod. The cap member 28 is of annular shape and as viewed in its normal operating position such as when it is secured to the powder holding chamber 22 as in FIG. 5, comprises an annular flat bottom portion 30 which is connected to the flexible strap 26. Extending upwardly of the bottom portion 30 is an annular inwardly sloping or inclined portion 22 and an annular intermediate raised portion 34 with a flat top surface 36 and extending upwardly thereof is an annular knob-like top portion 38 having a centrally positioned opening 40 in the end wall of the top portion. The underside of cap member 28 defined by the annular inwardly sloping portion 32, the intermediate raised portion 34 and the annular knob-like top portion 38 forms a gas chamber or bubble chamber generally indicated by the numeral 42 for the purpose hereinafter to be described.

Extending outwardly of the annular bottom portion 30 are a pair of diametrically opposed triangular-shaped extensions 44, each provided with an annular opening 46 communicating with a rectangular-shaped cutout 48. The extensions 44 extend lengthwise of the body or shell 12 and are adapted to form the holder for the ballast. The extensions 44 are positioned slightly off center and closer towards the side of the flexible strap 26 so that the openings 46, which receive the ballast rod, are slightly off center with respect to the longitudinal axis of the shell body 12. The off-center positioning of the ballast rod serves an important function in connection with the tipping of the toy object as will be more fully explained hereinafter. The annular bottom portion 30 of the cap member 28 has a lip portion 50 extending opposite to the side which attaches to the strap 26 so that the lip may be manually engaged in moving the cap member 28 into closing and opening positions with respect to the gas forming chamber 22. All of the foregoing structure is integrally molded in an injection molding machine as a one-shot operation and therefore may be inexpensively produced. Throughout its use, the foregoing structure remains in an integral unit with none of the foregoing being detachable from each other. Thus, irrespective of the small size of the entire unit, it remains sufficiently large enough to prevent a child from putting it into his mouth and swallowing it. The toy object may be small enough to be packaged in the same container as a food product, such as a cereal and the like, without contaminating the food product and with no possibility of injury to the child.

The only other component is a ballast rod generally indicated at 52 which is formed of a vinyl plastic so that it is heavier than water and still safe to be packaged with a food product. If desired, the ballast may be a metal rod. The ballast rod 52, which is herein described as a vinyl plastic, is flexible to a degree and is of a length so that it cannot be accidentally placed in the mouth and swallowed by a child. The ballast rod 52 is inserted in the openings 46 of the extensions 44 after first bending said extensions 44 at substantially right angles to the plane of cap member 28 as shown in FIG. 2. The ballast rod, when secured within the extensions, will extend across the bottom of the bubble chamber 42, but it will not interfere with the bubble. The ballast rod, as best shown in FIGS. 3 and 5, will be off center and will be slightly closer to the side having the flexible strap 26 than to the opposite side. The off-center position of the ballast rod 52 will influence the toy submarine to tip to one side as shown in FIG. 5 after it ascends in the water and permit the bubble to escape from the bubble chamber, so that the submarine can then descend into the water. This will be more fully understood in connection with the description of the operation which follows.

THE OPERATION

The operation of the device will now be described. With the member 28 attached to the shell body but positioned laterally thereof, the shell body of the toy is held with the bottom upward so that the powder holding chamber 22 can be filled with the gas forming material, such as baking powder. The baking powder is filled to the outer edge of the powder holding chamber and as the knob-like portion 38 of the cap member 28 is inserted, it compresses the powder in the chamber and holds it therein. Before closing the cap member 28 with respect to the powder holding chamber, a small amount of water is introduced into the chamber 22. Cap member 28 is then positioned as stated to close or cover the chamber 22 as shown in FIG. 5. The knob-like top portion 38 of the cap member will frictionally fit into the chamber and the annular flat surface 36 wil abut against the bottom edge of the chamber. The flat bottom portion 30 of the cap member 28 will be spaced slightly below the bottom edge 24 of the shell body 12 and the lip 50 will extend laterally of the shell body so that it can be subsequently manually grasped to move the cap member 28 to uncover the chamber 22 for insertion of additional baking powder.

With the cap member 28 in closed position as shown in FIG. 5, the interior of the powder holding chamber 22 occupied by the baking powder B communicates with the interior of the underside forming the gas or bubble chamber 42 through the cap opening 40. The toy device is then placed in a vessel or container filled with water. The toy device is held completely under the water and shaken three or four times after which it is released and will settle to the bottom due to the added weight of the ballast rod 52. Some of the water in the vessel or container will enter the powder holding chamber 22 through opening 40. Gas will then be formed in the gas chamber or bubble chamber 42 due to the water mixing with the powder and thus will cause a bubble to form in the bubble powder 42. As the bubble enlarges, it will cause the toy to slowly ascend in the water towards the top of the water level L. The toy will remain at the top water level for a short period of time during the period that the bubble enlarges in the bubble chamber 42. When the bubble enlarges, the toy will be influenced to tip to one side as shown in FIG. 5 due to the off-center ballast rod. In this instance, the ballast rod is closer to one side where the hinge strap 26 is located. Therefore, the toy will tip in the opposite direction. After the bubble leaves the bubble chamber and breaks, the toy will straighten out and descend to the bottom of the vessel. As the toy rests at the bottom, another bubble will be caused to form in the bubble chamber or gas chamber 42 and the same operation will be repeated to cause the toy to ascend and then descend. This operation continues until all the powder in the powder chamber 22 has been used up after which the cap 28 may be uncapped from the chamber 22 and the chamber may be refilled.

It should be noted that when the toy rises to the top of the water level, it will rise so that the top edge 18' of the tubular member 18 (conning tower) is at the water level L with the rest of the toy below the water level. As the toy tips to one side, the top edge 18' of the tubular member 18 on the side opposite to the side which carries the hinge strap 26 acts in effect as a pivot point between it and the top of the water level L as the toy pivots on the water at said point, then after the bubble leaves the bubble chamber 42 and breaks, the toy straigtens out and descends. The toy is below the top water level L when the bubble moves out of the bubble chamber 42 and breaks; therefore, the bubble is at all times below the water level during the operation of the toy.

The toy may be of any desired size; however, for packaging with cereal food products or the like, it is recommended that the toy body be approximately 3 inches in length and approximately 10/16 inch in width.

What is claimed is:

1. A toy object that repeatedly submerges and rises in water, comprising a body having a chamber for receiving a gas producing material, a cap having an aperture therein for sealing said chamber and providing communication between the water and said chamber through said aperture, a bubble retaining chamber for accommodating a gas bubble during the growth thereof, and a ballast longitudinally off-set of said body which in combination therewith provides an average density greater than water, whereby said toy object having a gas producing powder in said chamber sealed by said cap sinks in water until a bubble in said retaining chamber formed by coaction of water and the gas producing material is sufficiently large to cause said toy object to rise to the surface where said toy object tips to one side due to said longitudinally off-set ballast permitting the bubble to escape resulting in sinking of said toy object.

2. A toy object as set forth in claim 1 in which the toy object and cap are integrally formed of a plastic material and the cap has means for detachably holding a separate ballast member.

3. A toy object as set forth in claim 2, in which the ballast member is a rod.

4. A toy object as set forth in claim 3 in which the ballast rod is formed of a plastic material.

5. A toy object as set forth in claim 1 in which the cap is provided with oppositely positioned extensions having openings, which extensions are adapted to receive a ballast rod and position said ballast rod below the bottom of said toy object.

6. A toy object as set forth in claim 5 in which the extensions are formed integral with the cap and are then bent at right angles to the plane of the cap to receive the ballast rod and retain it in position and in which the ballast rod is held in an off-center position relative to the longitudinal axis of said toy object.

7. A toy object as set forth in claim 3 which has means extending upwardly of the main portion of the toy object which serves as a pivot point when the toy object tips to one side.

8. A toy object as set forth in claim 1 in which the cap member when positioned to close the first mentioned chamber compresses the baking powder in said chamber and in which the underside of said cap member facing downwardly is recessed to form the gas or bubble retaining chamber.

9. A toy object that repeatedly submerges and rises in water, comprising a body having only one chamber therein and a pivot member extending outwardly from said body, a cap having an aperture therein for sealing said chamber and providing communication between the water and said chamber through said aperture, a bubble retaining chamber separate from said body for accommodating a gas bubble during the growth thereof, and a ballast which in combination with said body provides an average density greater than water, said body and pivot member and ballast cooperating to ensure said toy object during operation thereof remains substantially submerged, whereby said toy object with a gas producing material in said chamber sealed by said cap sinks in water until a bubble in said retaining chamber formed by coaction of water and the gas producing material in said retaining chamber is sufficiently large to cause said toy object to rise until said pivot member breaks the water surface permitting said toy object to pivot about said pivot member releasing the gas bubble resulting in said toy object sinking.

10. The toy object set forth in claim 9, wherein said ballast is a separate member having a density greater than water, and said body has a density less than water.

11. The toy object set forth in claim 9, wherein said cap is frustoconical and hollow and forms said bubble retaining chamber.

* * * * *